US009580196B2

(12) United States Patent
Thomas

(10) Patent No.: US 9,580,196 B2
(45) Date of Patent: Feb. 28, 2017

(54) METHOD AND SYSTEM FOR PACKING BITUMEN

(75) Inventor: Gordon William Thomas, Singapore (SG)

(73) Assignee: EPS OFFSHORE OIL TRADING PLC, Roseau (DM)

( * ) Notice: Subject to any disclaimer, the term of this patent is extended or adjusted under 35 U.S.C. 154(b) by 825 days.

(21) Appl. No.: 13/984,030

(22) PCT Filed: Feb. 10, 2011

(86) PCT No.: PCT/SG2011/000063
§ 371 (c)(1),
(2), (4) Date: Oct. 16, 2013

(87) PCT Pub. No.: WO2012/108836
PCT Pub. Date: Aug. 16, 2012

(65) Prior Publication Data
US 2014/0041340 A1 Feb. 13, 2014

(51) Int. Cl.
*B65B 63/08* (2006.01)
*B65B 1/04* (2006.01)
(Continued)

(52) U.S. Cl.
CPC ..... *B65B 63/08* (2013.01); *B65B 1/04* (2013.01); *B65B 7/28* (2013.01); *B65B 11/50* (2013.01);
(Continued)

(58) Field of Classification Search
CPC ..... B65D 75/325; B65D 85/70; B65B 1/04; B65B 7/28; B65B 47/00; B65B 29/00; B65B 5/068; B65B 63/08; B65B 11/50; B65B 9/042; B65B 2220/24; B65B 3/00; B65B 3/04; B65B 3/045; B65B 3/10; B65B 3/12;
(Continued)

(56) References Cited

U.S. PATENT DOCUMENTS 3,366,233 A * 1/1968 Roediger ..... B32B 27/00 206/524.2
3,832,825 A * 9/1974 Dunbar ..... B65B 63/08 53/411
(Continued)

FOREIGN PATENT DOCUMENTS

SG WO2010/090595 A1 8/2010
WO WO 2009153324 A1 * 12/2009 ..... B29B 11/10

OTHER PUBLICATIONS

International Search Report of international patent application No. PCT/SG2011/000063 completed on Apr. 6, 2011 and mailed Apr. 13, 2011 (3 pages).

*Primary Examiner* — Thanh Truong
*Assistant Examiner* — Thomas Wittenschlaeger
(74) *Attorney, Agent, or Firm* — Pyprus Pte Ltd

(57) ABSTRACT

A method for packing bitumen in a continuous process is disclosed. To pack the bitumen, a tray having one or more bitumen-receiving cavities is prepared. The cavity of the tray is coated with polymer film and bituminous film consecutively. Following that, the bitumen, in liquid form, is filled into the coated cavity. Additional layer of bituminous and polymer film are then consecutively laid over the bitumen-filled cavity, encapsulating the bitumen thereto. A system to form such bitumen package is also disclosed herein.

9 Claims, 3 Drawing Sheets

(51) Int. Cl.

| | |
|---|---|
| ***B65B 47/00*** | (2006.01) |
| ***B65B 7/28*** | (2006.01) |
| ***B65D 75/32*** | (2006.01) |
| ***B65D 85/00*** | (2006.01) |
| ***B65B 11/50*** | (2006.01) |
| *B65B 29/00* | (2006.01) |
| *B65B 5/06* | (2006.01) |

(52) U.S. Cl.
CPC ..... *B65B 47/00* (2013.01); *B65D 75/325* (2013.01); *B65D 85/70* (2013.01); *B65B 5/068* (2013.01); *B65B 29/00* (2013.01)

(58) Field of Classification Search
CPC .... B65B 3/14; B65B 3/06; B65B 3/08; B29C 41/32; B29C 41/386; B29C 39/123
USPC ..... 53/428, 440, 122, 127, 475, 246; 425/112, 113; 264/255, 4, 334, 338, 264/DIG. 32
See application file for complete search history.

(56) References Cited

U.S. PATENT DOCUMENTS

| | | | | |
|---|---|---|---|---|
| 4,738,997 | A * | 4/1988 | Lundberg | C08L 95/00 524/68 |
| 4,882,107 | A * | 11/1989 | Cavender | B05D 1/025 264/175 |
| 5,682,758 | A * | 11/1997 | Jones | B65B 63/08 264/299 |
| 5,715,654 | A * | 2/1998 | Taylor | B29B 13/022 264/255 |
| 2003/0091389 | A1 | 5/2003 | Zentner | |
| 2007/0027235 | A1 * | 2/2007 | Marchal | C08L 23/0853 524/59 |
| 2008/0015288 | A1 * | 1/2008 | Antoine | B29C 47/0004 524/69 |
| 2009/0000976 | A1 | 1/2009 | Thorat et al. | |

* cited by examiner

METHOD AND SYSTEM FOR PACKING BITUMEN

FIELD OF THE INVENTION

The present invention relates to bitumen packaging, in particular, to a method and system for packing bitumen.

BACKGROUND

Bitumen, also known as asphalt, is a petroleum derivatives product which has been widely used as construction material. Bitumen, including naturally occurring bitumen and refined bitumen obtained from fractional distillation of crude oil, is semi-solid and very sticky at room temperature. When bitumen is heated up to an elevated temperature, it appears in a liquid form.

Bitumen is transported from oil refineries to user site in a number of ways. One way of transporting it is by heated tankers. Nevertheless, transportation by heated tankers consumes significant amount of energy, thus making it costly. Beside that, transportation of bitumen by heated tankers is also considered hazardous.

Another way for transporting bitumen would be transportation of cold bitumen in metal drums. While considered safe, transportation of cold bitumen by metal drums leads to wastage of bitumen as stickiness of bitumen makes it very difficult to recover all bitumen from the metal drums upon usage. About 2-3% of the bitumen is left as residues in the metal drums. Additionally, after it has been used once in transporting bitumen, the metal drums cannot be recycled for another usage, thus disposal of the used metal drums, with bitumen residues stick to the drums, leads to an environmental issue.

Attempts have also been made to use materials such as polymers and paper bag for packing bitumen. US Patent Publication no. 2009/0000976 discloses a method to pack bitumen using polymer bag for easy storage, handling, and transportation. To prepare a bitumen package, a pre-fabricated empty polymer bag having opening at the top is held firmly in a metal mould. The metal mould is then placed in a coolant/water tank. Following that, bitumen in liquid form is poured into the polymer bag with the help of a funnel. After that, the polymer bag is sealed and the sealed bag is placed on pallet, ready for further storage and transportation.

SUMMARY

In one aspect of the present invention, there is provided a method for packing bitumen in continuous process, wherein the method comprises the steps of providing a tray having one or more bitumen-receiving cavities; extruding a first polymer film into the tray in such a way that the tray is coated with the first polymer film; extruding a first bituminous film into the tray in such a way that the tray is further coated with the first bituminous film, wherein the first bituminous film is laid over the first polymer film; filling the cavities of the tray with the bitumen; extruding a second bituminous film for covering the filled tray; extruding a second polymer film for further covering the filled tray, wherein the second polymer film is laid over the second bituminous film, forming a bitumen package therein; cooling down the filled tray in such a way that the bitumen package is hardened; and releasing the hardened bitumen package from the tray by tilting the filled tray upside down. It is required to pre-set the bitumen at its extrudable temperature range before dispensing the bitumen into the cavities of the tray. It is also required that the second bituminous film is extruded at sufficiently high temperature of 180° C. to 200° C. that it bonds to the first bituminous film, forming a means of packaging.

In a further embodiment of the present invention, the method for packing bitumen further comprises the steps of cooling down the tray in a chilled-water bath prior to extruding any films into the tray. The cooled tray might be further coated with a mould release agent for preventing any extruded films from sticking to the tray once the film is extruded into the tray.

In one embodiment of the present invention, the bitumen is a normal grade bitumen and its extrudable temperature range is in the range of 50° C.~80° C.

In another embodiment, the bitumen is a polymer modified bitumen (PMB) and its extrudable temperature range is in the range of 90° C.~120° C.

In another aspect of the present invention, there is provided a method for packing bitumen in a continuous process, wherein the method comprises the steps of providing a tray having one or more bitumen-receiving cavities; extruding a first polymer film into the tray in such a way that the tray is coated with the first polymer film; filling the cavities of the tray with the bitumen; extruding a second polymer film for covering the filled tray, forming a bitumen package therein; cooling down the filled tray in such a way that the bitumen package is hardened; and releasing the hardened bitumen package from the tray by tilting the tray upside down.

In yet another aspect of the present invention, there is provided a bitumen package comprising a plurality of bitumen slabs, wherein each of the bitumen slabs comprises of bitumen encapsulated in two layers of packaging, the first layer of packaging, which comprises bituminous film, encapsulates the bituminous product and the second layer of packaging, which comprises polymer film, encapsulates the bituminous product being encapsulated by the first packaging. Each of the bitumen slabs are joined to each other by a web, forming a bitumen package with chocolate bar configuration. In a further embodiment of the present invention, any type of bituminous material or viscous material can also be encapsulated and formed into the bitumen package.

In another aspect of the present invention, there is provided a system for packing bituminous product, wherein the system comprises trays, with a tray having one or more bitumen-receiving cavities; a conveyor system for transportation of the trays, one at a time, to a plurality of workstations. The plurality of workstations comprises a workstation comprising a polymer extruder for extruding a polymer film for coating each of the trays, wherein the bitumen-receiving cavities of the trays are in an empty condition; a workstation comprising a bituminous film extruder for extruding a bituminous film for further coating each of the trays as the trays are being conveyed to the workstation of the bituminous film extruder from the workstation of the polymer extruder; a workstation of comprising a bitumen dispenser for filling bitumen into the bitumen-receiving cavities of the trays as the trays are being conveyed to the workstation comprising the bitumen dispenser from the workstation comprising the bituminous film extruder; a workstation comprising a second bituminous film extruder for extruding a second bituminous film for covering the filled trays as the filled trays are being conveyed to the workstation comprising the second bituminous film extruder from the bitumen dispenser; a workstation comprising a second polymer film extruder for extruding a second polymer film for further covering the filled trays as the filled trays are being conveyed to the workstation comprising the second polymer film extruder from the workstation comprising the second bituminous film extruder and thereby forming a bitumen package in each tray; a workstation comprising a knife blade to cut joined polymer and bituminous films between two filled trays; a workstation comprising a chilled-water bath for hardening the bitumen packages contained in the filled trays; and a workstation comprising a conveyor return leg for tilting the filled trays upside down to release the hardened bitumen packages from the trays.

In a further embodiment, the system for packing bituminous product further comprises a workstation of a second chilled-water bath to cool down the tray after the bitumen package is released from the tray.

In yet a further embodiment, the system for packing bituminous product further comprises a workstation of a bath of mould release agent for coating the tray with a mould release agent after the tray is cooled down.

In another embodiment of the present invention, the surface of the trays is made of non-sticky materials. It is also preferable that the surface of the tray is made of materials that are suitable for coating with mould release agent.

In one embodiment of the present invention, the bitumen dispenser comprises a plurality of bitumen containers to contain bitumen at its extrudable temperature range, the bitumen containers are further connect to pistons wherein the pistons are used to pump the bitumen contained in the bitumen containers into the bitumen-receiving cavities of the trays. The pistons used to pump the bitumen are either pneumatically operated pistons or hydraulically operated pistons.

In a further embodiment of the present invention, the bitumen contained in the bitumen containers is received from a water-jacketed tank, wherein the water-jacketed tank is configured to set the bitumen at its extrudable temperature range. In the water-jacketed tank, the bitumen is being agitated by either hydraulically or pneumatically operated mixers to achieve a consistent temperature within the bitumen-thereof.

In another aspect of the present invention, there is provided a system for packing bituminous product, wherein the system comprises trays, with each tray having one or more bitumen-receiving cavities; a conveyor system for transportation of the trays to a plurality of workstations. The plurality of workstations comprises: a workstation comprising a polymer extruder for extruding a polymer film for coating the trays; a workstation comprising a bitumen dispenser for filling bitumen into the bitumen-receiving cavities of the trays as the trays are being conveyed to the workstation comprising the bitumen dispenser from the workstation comprising the bituminous film extruder; a workstation comprising a second polymer film extruder for extruding a second polymer film for further covering the filled trays as the filled trays are being conveyed to the workstation comprising the second polymer film extruder from the workstation comprising the second bituminous film extruder, thereby forming a bitumen package in each tray; a workstation comprising a knife blade to cut joined polymer and bituminous films between two filled trays; a workstation comprising a chilled-water bath for hardening the bitumen packages formed in the filled trays; and a workstation comprising a conveyor return leg for tilting the filled trays down for releasing the hardened bitumen packages from the trays.

BRIEF DESCRIPTION OF THE DRAWINGS

This invention will be described by way of non-limiting embodiments of the present invention, with reference to the accompanying drawings, in which.

DETAILED DESCRIPTION

Figure 1:
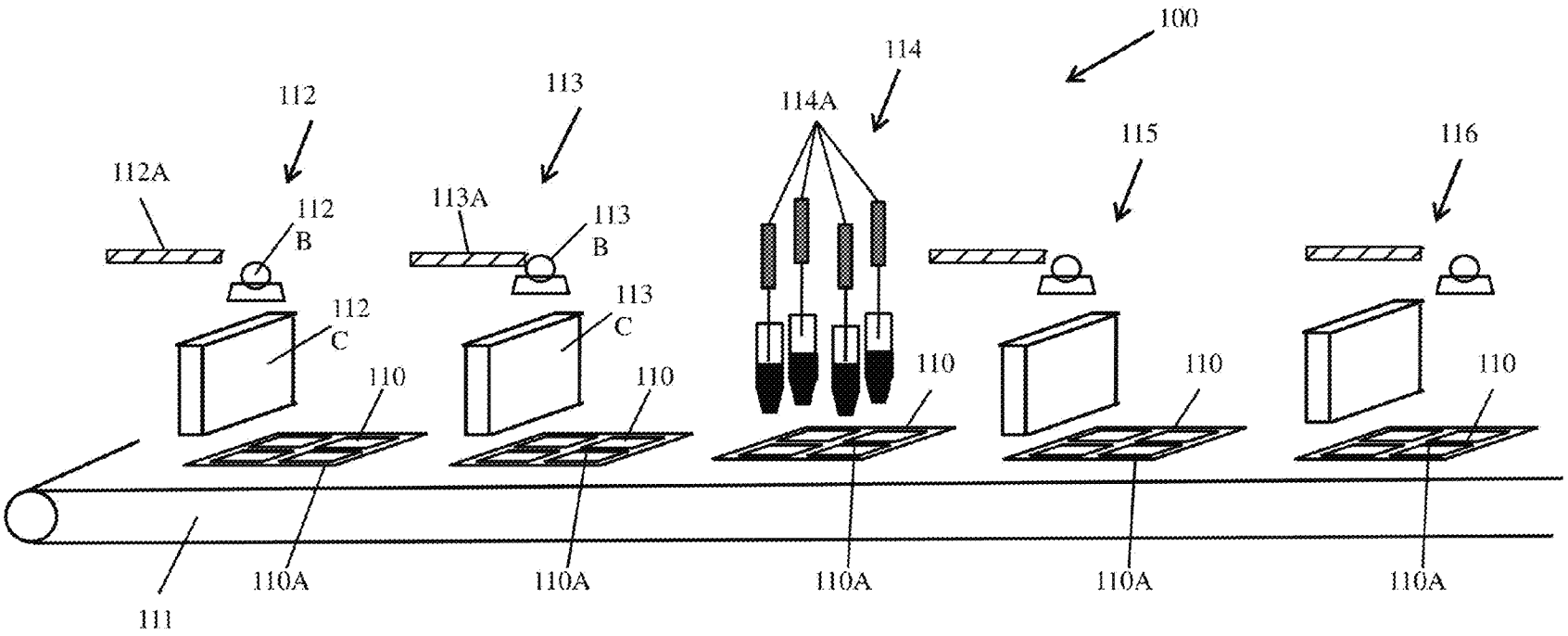
FIG. 1 illustrates sequences of an encapsulation process for packing bitumen according to a preferred embodiment of the present invention.

The following descriptions of a number of specific and alternative embodiments are provided to understand the inventive features of the present invention. It shall be apparent to one skilled in the art, however that this invention may be practiced without such specific details. Some of the details may not be described in length so as to not obscure the invention. For ease of reference, common reference numerals will be used throughout the figures when referring to same or similar features common to the figures.

Conventionally, bitumen is packed in a batch process, wherein packaging/bags are pre-prepared, and bitumen is filled into the packaging/bags afterwards. The batch process involves a plurality of steps and handlings; hence it might not be effective in a bitumen package production.

The present invention discloses an improved method for packing bitumen. In the present invention, during production of bitumen packages, bitumen is dispensed and encapsulated with packaging films in a single continuous process, hence preventing unnecessary handlings during the process. Moreover, the method of the present invention is also operable at a higher volume than the above-mentioned conventional method, and therefore, with the method of the present invention, volume requirements in bitumen package production can be met.

The packaging of the present invention comprises polymer film and bituminous film. The packaging films are totally compatible and miscible with a melt of the bitumen content. While the bitumen package is heated, the packaging films integrate into the bitumen content, maintaining original specifications of the bitumen content, or even enhancing quality of the bitumen content by transforming it into Polymer Modified Bitumen (PMB), a type of bitumen with internationally-recognized specifications. Furthermore, the bitumen package of the present invention can be securely stacked, transported and stored at ambient temperature, therefore enhancing safety, eliminating environmental issue, as well as minimizing expenditures of bitumen transportation.

FIG. 1 illustrates sequences of an encapsulation process 100 for packing bitumen according to a preferred embodiment of the present invention. To produce a bitumen package, a tray 110 with one or more bitumen-receiving cavities 110A is mounted on a conveyor 111. In the encapsulation process 100, the conveyor 111 conveys the moulding tray to a plurality of workstations at a constant speed.

At a first stage of the process 100, the conveyor 111 delivers the tray 110 to a workstation comprising a polymer film extruder 112. The polymer film extruder 112 extrudes a first polymer film, preferably with a thickness of 10 to 30 μm, into the cavities 110A of the tray 110, coating whole surfaces of the cavities 110A therein. The first polymer film is aimed to act as a non-sticky coating of a bitumen package and is extruded at a very high temperature range, about 120° C. to 180° C. The polymer film extruder 112 comprises a melt extruder screw 112A, which is connected to a melt pump 112B, and a die 112C. The melt extruder screw 112A melts ingredients of the first polymer film and sends the melted ingredients to the melt pump 112B. The melt pump 112B pumps the melted ingredients to the die 112C, which forms the ingredients into the first polymer film, and simultaneously extrudes the first polymer film into the tray 110.

At a second stage of the process 100, the tray 110 is sent to a workstation comprising a bituminous film extruder 113 wherein the bituminous extruder 113 extrudes a first bituminous film onto the cavities 110A of the tray 110. The first bituminous film is laid over the first polymer film extruded at the first stage of the process 100. A bituminous film disclosed in WO 2010/090595 might be used herein. The bituminous film extruder 113 comprises a melt extruder screw 113A, which is connected to a melt pump 113B, and a die 113C. The melt extruder screw 113A melts ingredients of the first bituminous film and sends the melted ingredients to the melt pump 113B. The melt pump 113B pumps the melted ingredients to the die 113C, which forms the ingredients into the first bituminous film, and simultaneously extrudes the first bituminous film into the tray 110. It is preferable that the bituminous film is extruded at a temperature range of 180° C. to 200° C.

At a third stage of the process 100, the tray 110 moves to a workstation of bitumen-filling dispenser 114. The bitumen-filling dispenser 114 comprises a plurality of bitumen containers 114A, wherein each of the containers contains bitumen at a measured quantity. The bitumen, in liquid form, is expelled from the containers 114A of the bitumen-filling dispenser 114 into the tray cavities 110A, upon the layer of bituminous film, by either hydraulically or pneumatically operated pistons. The pistons have pneumatically-operated valves which are opened accordingly with activation of the pistons. In order to have the cavities 110A filled with the bitumen precisely while the tray 110 is moved forward by the conveyor 111, bitumen dispensing rate and speed of the conveyor 110 are synchronized via a process control panel.

It is desired that before being dispensed, the bitumen is cooled down to its extrudable temperature whereby the temperature is hot enough that the bitumen is still pumpable/dispensable, yet low enough that it does not affect the underlying films. The extrudable temperature of bitumen depends on the type of the bitumen. Different types of bitumen might have different extrudable temperatures.

To cool down the bitumen, the bitumen, which is received from refineries at a temperature range of 110° C. to 180° C., is sent to a water-jacketed tank. In the water-jacketed tank, the bitumen is agitated by either hydraulically or pneumatically operated mixers. Traditional mixers, such as propeller types, are not suitable for agitation, as they will seize, up when viscosity of the bitumen thickens. Bitumen is a good thermal insulator, and hence only bitumen coming in contact with the water-jacketed tank will be cooled down. Therefore, to achieve a consistent temperature within the bitumen in the tank, the bitumen must be agitated sufficiently. In the present invention, it is desired that normal grade bitumen is agitated until the temperature of the bitumen is reduced to a range of 50° C. to 80° C., whilst polymer modified bitumen (PMB) is agitated until the temperature of PMB reaches a temperature range of 90° C. to 120° C. Once the bitumen reaches the extrudable temperature, the bitumen is then pumped to the bitumen-filling containers 114A and dispensed to the bitumen receiving cavities 110A, upon the layer of bituminous film.

Although the bitumen is already being cooled down in the water-jacketed tank prior to dispensing to the bitumen receiving cavities 110A, the temperature of the bitumen is still considered high. Nevertheless, the underlying bituminous film is able to withstand the heat of the bitumen, that the heat of the bitumen does not affect/damage the underlying bituminous film.

Still referring to FIG. 1, at a fourth stage of the process, the filled tray is conveyed to a workstation comprising a second bituminous film extruder 115. A second bituminous film is extruded by the second bituminous film extruder 115 to cover the filled tray. Components and functions the second bituminous film extruder 115 are similar to the bituminous film extruder 113, and therefore will not be further elaborated herein. At the fourth stage of the process, the second bituminous film is extruded at a sufficiently high temperature, approximately at a temperature range of 180° C. to 200° C., so that it bonds to the first bituminous film formed at the second stage of the process 100, thereby forming a means of packaging. Apparently, the bituminous film used at the second stage of the process 100, might also be used herein.

At a fifth stage of the process 100, the tray 110 is sent to a workstation comprising a second polymer film extruder 116, which components and functions are similar to those of the polymer film extruder 112. A second polymer film, preferably with a thickness of 10 to 30 μm, is extruded upon the second bituminous film at a temperature range of 120° C. to 180° C. It is desired that the polymer film is a non-sticky polymer film. At the end of the fifth stage of the process 100, bitumen is completely encapsulated with both the polymer and bituminous films, thus forming a final product of a bitumen package.

Since the films of the bitumen packaging are formed in a continuous process, several of the trays 110 are joined to each other by the films. To separate the joined trays, they are conveyed to a workstation comprising a knife blade, wherein the knife blade is propelled rapidly between the joined trays so that the films are cut and each tray 110 is separated one from another.

After the bitumen packages are formed in the tray 110, the tray 110 is conveyed to a workstation of a chilled-water bath. In the chilled-water bath, the bitumen packages are cooled down, and hence hardened to a sufficient hardness so that the bitumen package can be stacked or packed in a high volume.

At the end of the process 100, the tray 110 is tilted upside down as the conveyor 100 makes a return leg. The bitumen packages, hence, are tipped out of the tray 110 and sent for storage. After the tray 110 is emptied, the tray 110 is submerged in a workstation comprising a second chilled-water bath and is cooled down. Once cooled down, the tray 110 returns to the first stage of the process 100, and is ready to form another batch of bitumen package. It is important to cool down the tray 110 to a sufficient temperature, before extruding any films into the tray. The differential temperature between the cooled tray and the extruded film must be high enough so that a freeze reaction could occur as the film is being extruded onto the tray 110. The freeze reaction prevents the extruded film from sticking to the tray 110, hence the formed bitumen package can be released from the tray 110 with ease. The differential temperature between the cooled tray and the extruded polymer film is determined by the type of polymer film being used to form the bitumen package. Preferably, the differential temperature between the cooled tray and the extruded film is in the range of 160° C. to 200° C.

In another embodiment of the present invention, it is also possible to pass the tray 110 to a bath of mould release agent, after the tray 110 is cooled down in the second chilled-water bath. In the bath of mould release agent, the tray 110 is pre-coated with a non-stick mould release agent, wherein the non-stick mould release agent further prevents the extruded films from sticking to the tray 110 as the bitumen package is formed in the tray 110. After the tray 110 is coated with the non-stick mould release agent, the tray 110 is then conveyed to the first stage of the encapsulation process 100.

Figure 1A:
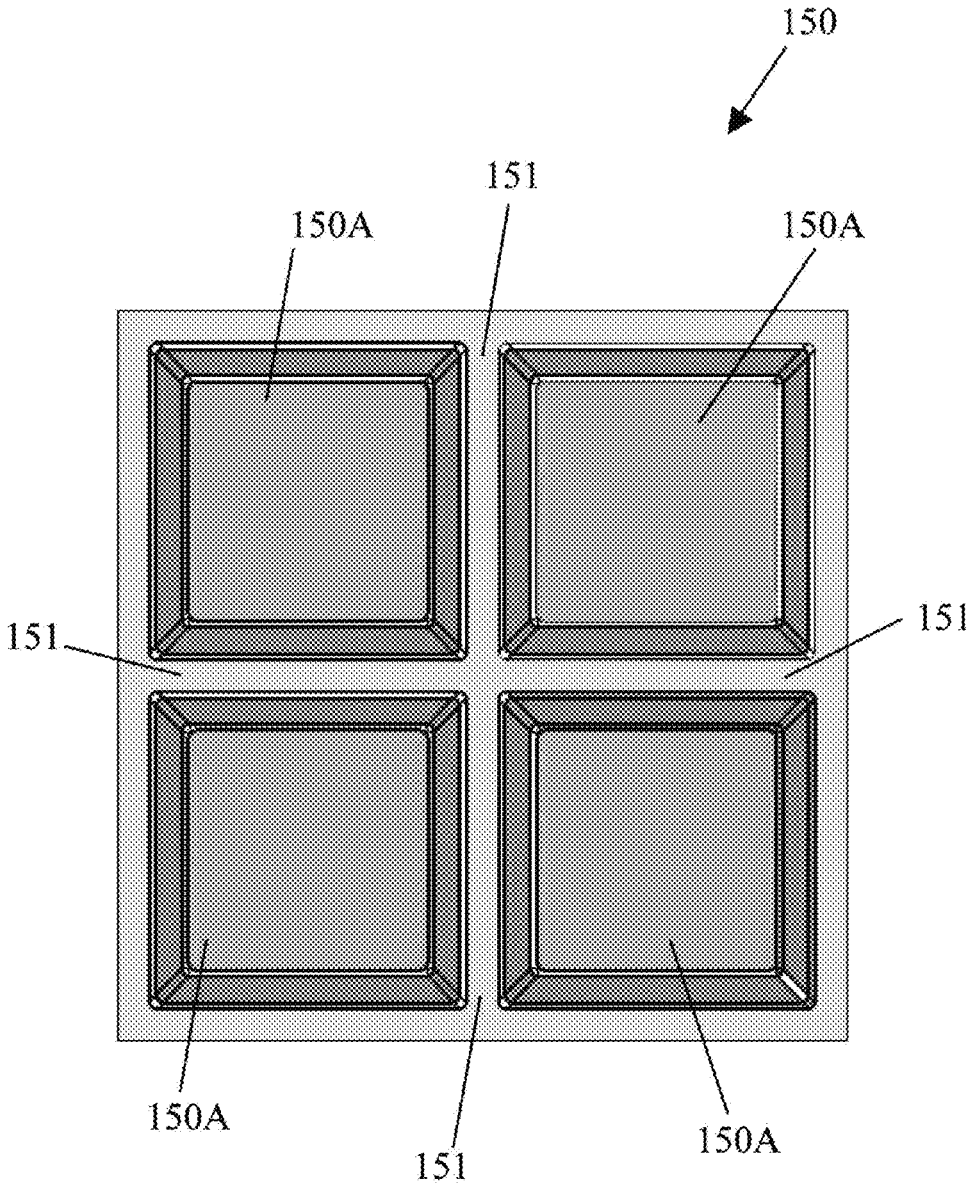
FIG. 1A illustrates bitumen packages produced in accordance with the present invention.

FIG. 1A illustrates bitumen packages 150 are produced in accordance with one embodiment of the present invention. The bitumen packages 150 comprise a plurality of single bitumen slabs 150A, which are joined to each other by a web 151, thus forming a chocolate bar configuration. In one embodiment of the present invention, the length of the web 151 is around 500 mm. The chocolate bar configuration of the bitumen packages 150 is advantageous for storage and transportation of the bitumen packages 150, as with this configuration, the bitumen packages 150 can be kept in place and securely stacked.

Figure 1B:
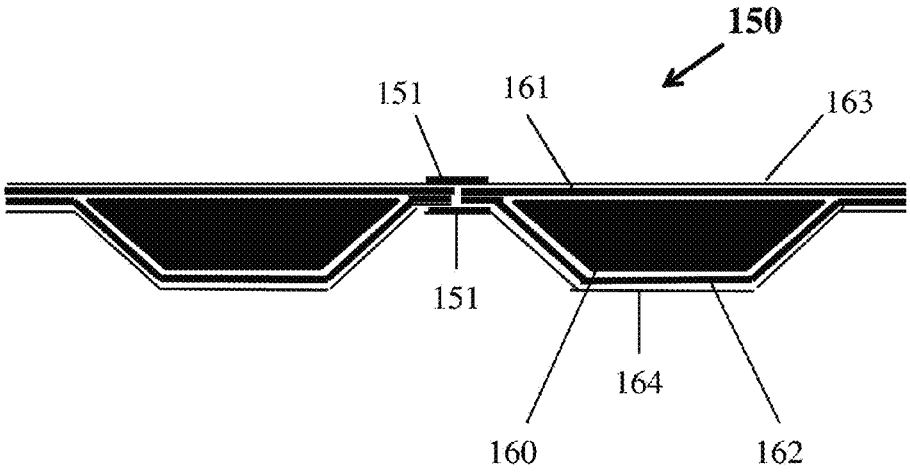
FIG. 1B illustrates a side view of the bitumen packages of FIG. 1A.

FIG. 1B illustrates a side view of the bitumen packages 150 of FIG. 1A. As mentioned above, the bitumen packages 150 comprise a plurality of single bitumen slabs 150A, which are joined by a web 151, forming a chocolate bar configuration. The single bitumen slabs 150A comprises bitumen 160 encapsulated in several layers of packaging film 161, 162, 163, 164. The bitumen 160 is encapsulated directly by a layer of bituminous film each at a top 161 and a bottom 162 of the bitumen 160, forming a means of packaging. Packing bitumen using the bituminous films 161, 162 is advantageous because the bituminous films 161, 162 are able to withstand the heat of the bitumen that is dispensed at high temperature during the packing process.

Still referring to FIG. 1B, over the layer of bituminous film 161, 162, the bitumen 160 is further encapsulated by a layer of polymer sheet, each at top 163 and bottom 164 of the bituminous film 161, 162. Similarly, the layers of polymer sheet 163, 164 also form a means of packaging, further encapsulating the bitumen. The thickness of each film 161, 162, 163, 164 depends on amount of bitumen 160 being encapsulated. In one embodiment of the present invention, the thicknesses of the polymer film 163, 164 and the bituminous film 161, 162 are 30 μm to 100 μm and 1 to 2 mm respectively, whilst the thickness of the bitumen 160 encapsulated is 50 mm to 200 mm.

Figure 2:
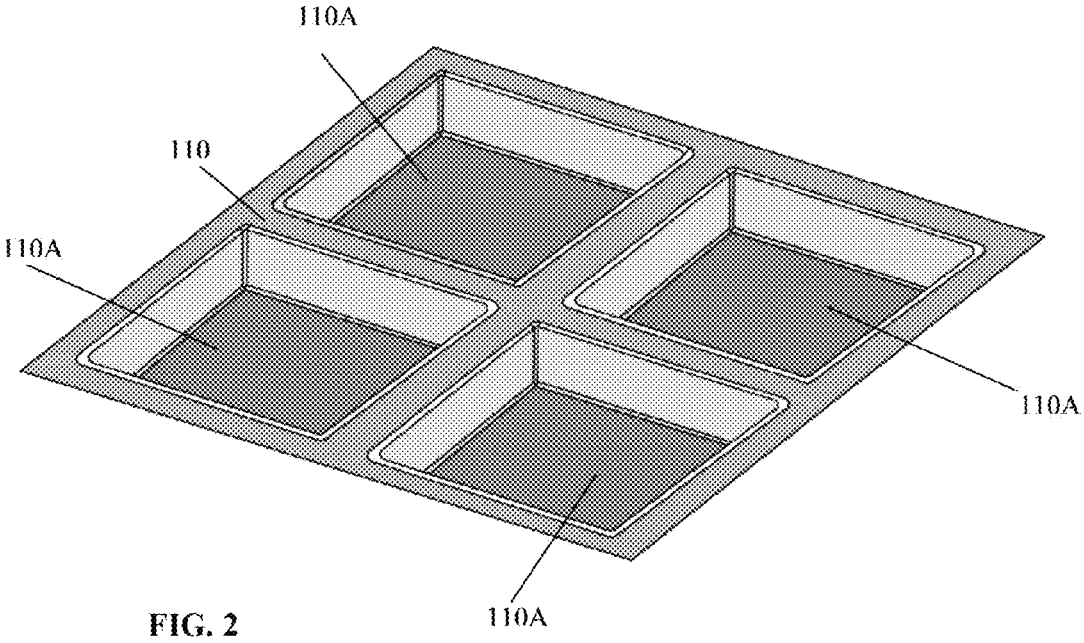
FIG. 2 exemplifies a tray for forming bitumen package according to the present invention.

FIG. 2 exemplifies a tray 110 for forming a bitumen package according to a preferred embodiment of the present invention. In FIG. 2, the tray is illustrated as a rectangular-shaped tray with four cavities 110A formed therein. However, there is nothing critical about shape of the tray and number of cavities formed therein. Therefore, in the present invention, any shape of tray with any number of cavities can be used to form a bitumen package depending on desired shape, size, and weight of the bitumen package. Usually, the shape, size, and weight of the bitumen package are determined by facilities available an end-user site that help a user to lift or handle the bitumen package. By changing the design of the tray 110, the dimension of the bitumen package can be flexibly adjusted according to one's needs and facilities available at the end-user's site to handle the bitumen package.

Still referring to FIG. 2, the tray 110 is made of any materials that can withstand heat transferred by the extruded polymer film, bituminous film, and bitumen during the encapsulation process 100 shown in FIG. 1. Surface of the tray 110, especially surfaces of the cavities 110A, must be made or coated with of non-sticky materials, such as silicon-based material, so that the polymer film can be released from the cavities 110A with ease.

The process 100 of the present invention, wherein bitumen is packed with a layer of polymer film and bituminous film each, is very important, especially when it comes to a production of Polymer Modified Bitumen (PMB) package. When only a polymer film is used to pack the PMB, the film might not be able to withstand the heat of the PMB, which need to be dispensed at its extrudable temperature of a as high as 90° C. to 120° C. With the high temperature of PMB, the heat of PMB might damage the polymer film. Nevertheless, the bituminous film used in the present invention, which directly encapsulates and in touch with the bitumen, is able to withstand the heat of the PMB and encapsulate it, without affecting/damaging the film itself. Therefore the process 100 is able to yield good bitumen package, regardless of the extrudable temperature of the bitumen. For example, the process 100 is also favourable for packing normal grade bitumen.

In another embodiment of the present invention, packing normal grade bitumen, which is dispensed at considerably low temperature of 50° C. to 80° C. compared to PMB, can be achieved by encapsulating the bitumen only with polymer film, without any bituminous film. This is due to the polymer film itself is able to withstand the heat of the dispensed normal grade bitumen, that it can make a good packaging when being used alone. In this instance, the encapsulation process comprises the steps of providing the tray having one or more bitumen receiving cavities; extruding a polymer film onto the tray; filling the bitumen receiving cavities with bitumen; extruding a second polymer film onto the tray, forming a bitumen package therein; hardening the bitumen package; and releasing the bitumen package from the tray. The thickness of the polymer film is dependant on type of polymer film being used. In a further embodiment, Styrene Butadiene Styrene (SBS) film with a thickness of 30 μm might be used to encapsulate the normal grade bitumen. In yet another further embodiment, Polyethylene (PE) film with a thickness of 100 μm might also be used to encapsulate the normal grade bitumen.

Whilst the process 100 has been elaborated broadly to pack a content of bituminous product, the present invention can be adapted to pack any other viscous products with selection of appropriate packaging materials.

The above description illustrates various embodiments of the present invention along with examples of how aspects of the present invention may be implemented. While specific embodiments have been described and illustrated it is understood that many charges, modifications, variations and combinations thereof could be made to the present invention without departing from the scope of the present invention. The above examples, embodiments, instructions semantics, and drawings should not be deemed to be the only embodiments, and are presented to illustrate the flexibility and advantages of the present invention as defined by the following claims:

The invention claimed is:

1. A system for packing bituminous product, the system comprising:

trays, with each tray having one or more bitumen-receiving cavities;

a conveyor system for transportation of the trays, one at a time, to a plurality of workstations, wherein the plurality of workstations comprises:

a workstation comprising a polymer extruder for extruding a polymer film for coating each of the trays, wherein the bitumen-receiving cavities of the trays are in an empty condition;

a workstation comprising a bituminous film extruder for extruding a bituminous film for further coating each of the trays as the trays are being conveyed to the workstation comprising the bituminous film extruder from the workstation comprising the polymer extruder;

a workstation comprising a bitumen dispenser for filling bitumen into the bitumen-receiving cavities of each of the trays as the trays are being conveyed to the workstation comprising the bitumen dispenser from the workstation comprising the bituminous film extruder;

a workstation comprising a second bituminous film extruder for extruding a second bituminous film for covering each of the filled trays as the filled trays are being conveyed to the workstation comprising the second bituminous film extruder from the bitumen dispenser;

a workstation comprising a second polymer film extruder for extruding a second polymer film for further covering each of the filled trays as the filled trays are being conveyed to the workstation comprising the second polymer film extruder from the workstation comprising the second bituminous film extruder, thereby forming a bitumen package in each tray;

a workstation comprising a knife blade to cut joined polymer and bituminous films between two filled trays;

a workstation comprising a chilled-water bath for hardening the bitumen packages contained in the filled trays; and a workstation comprising a conveyor return leg for tilting the filled trays upside down to release the hardened bitumen packages from the trays.

2. The system of claim 1, further comprises a workstation comprising a second chilled-water bath to cool down the tram after the bitumen packages are released from the trays.

3. The system of claim 2, further comprises a workstation comprising a bath of mould release agent for coating each of the trays with a mould release agent after the trays are cooled down.

4. The system of claim 1, wherein the surface of the trays is made of materials that are suitable for coating with a mould release agent.

5. The system of claim 1, wherein the bitumen dispenser comprises a plurality of bitumen containers to contain bitumen in the bitumen extrudable temperature range, the bitumen containers are further connected to pistons wherein the pistons are used to pump the bitumen contained in the bitumen containers into the bitumen-receiving cavities of each of the trays.

6. The system of claim 5, wherein the pistons used to pump the bitumen are pneumatically operated pistons.

7. The system of claim 5, wherein the pistons used to pump the bitumen are hydraulically operated pistons.

8. The system of claim 5, wherein the bitumen contained in the bitumen containers is received from a water-jacketed tank, with the water-jacketed tank being configured to set the bitumen at the bitumen extrudable temperature range.

9. The system of claim 8, wherein the bitumen in the water-jacketed tank is being agitated by either hydraulically or pneumatically operated mixers to achieve a consistent temperature within the bitumen.

* * * * *